US011051618B2

(12) United States Patent
Chen et al.

(10) Patent No.: US 11,051,618 B2
(45) Date of Patent: Jul. 6, 2021

(54) ROCKING FOLDABLE CHAIR

(71) Applicant: Libin Chen, Changzhou (CN)

(72) Inventors: Libin Chen, Changzhou (CN); Qinglei Kong, Changzhou (CN)

(73) Assignee: Libin Chen, Changzhou (CN)

( * ) Notice: Subject to any disclaimer, the term of this patent is extended or adjusted under 35 U.S.C. 154(b) by 0 days.

(21) Appl. No.: 16/669,544

(22) Filed: Oct. 31, 2019

(65) Prior Publication Data

US 2020/0390242 A1 Dec. 17, 2020

(30) Foreign Application Priority Data

Jun. 13, 2019 (CN) ..... 201920893837.1

(51) Int. Cl.

| | |
|---|---|
| ***A47C 3/00*** | (2006.01) |
| ***A47C 3/021*** | (2006.01) |
| ***A47C 4/30*** | (2006.01) |
| ***A47C 4/28*** | (2006.01) |

(52) U.S. Cl.

CPC ..... *A47C 3/021* (2013.01); *A47C 4/283* (2013.01); *A47C 4/30* (2013.01)

(58) Field of Classification Search

CPC ..... A47C 3/029; A47C 4/286; A47C 4/22; A47C 5/10; A47C 3/02; A47C 3/023; A47C 4/03; A47C 3/0255; A47C 4/00

See application file for complete search history.

(56) References Cited

U.S. PATENT DOCUMENTS

| | | | | |
|---|---|---|---|---|
| 2,718,916 | A * | 9/1955 | Borochoff | A47C 3/023 297/287 |
| 4,047,753 | A * | 9/1977 | Uchida | A47C 3/029 297/32 |
| 4,674,795 | A * | 6/1987 | Nelson | A47C 3/023 297/239 |
| 4,790,596 | A * | 12/1988 | Shifferaw | A47C 3/021 248/628 |
| 5,499,857 | A * | 3/1996 | Lynch, Jr. | A47C 4/286 297/16.2 |
| 5,813,727 | A * | 9/1998 | Sugawa | A47C 1/024 297/411.42 |
| 6,439,656 | B1 * | 8/2002 | Liu | A47C 3/029 297/271.6 |
| 6,616,237 | B2 * | 9/2003 | Sonner | A47D 13/107 297/440.22 |
| 6,676,206 | B2 * | 1/2004 | Brandschain | A47C 3/029 297/259.2 |

(Continued)

*Primary Examiner* — Shin H Kim

(74) *Attorney, Agent, or Firm* — Bayramoglu Law Offices LLC

(57) ABSTRACT

A rocking foldable chair includes a body frame and a support portion. A connecting portion bent upward is fixed at the first end of the support portion. The connecting portion and the support portion are formed into a piece. One end, away from the support portion, of the connecting portion is fixedly connected to the body frame. The second end of the support portion extends toward the rear of the body frame. The connecting portion is elastically deformed by an external force, so that the body frame rocks back and forth. The body frame further comprises a first support rod, a second support rod and a second connecting rod. The second support leg is further provided with a pop-up device capable of providing the second support leg with a resilient force.

12 Claims, 7 Drawing Sheets

(56) References Cited

U.S. PATENT DOCUMENTS

| | | | | |
|---|---|---|---|---|
| 7,100,975 | B1 * | 9/2006 | Zheng | A47C 3/029 297/271.6 |
| D565,852 | S * | 4/2008 | Wang | D6/348 |
| 8,893,326 | B2 * | 11/2014 | Goods | A47D 13/107 5/101 |
| D728,949 | S * | 5/2015 | Fang | D6/348 |
| 2003/0214159 | A1 * | 11/2003 | Brandschain | A47C 4/22 297/32 |
| 2004/0251729 | A1 * | 12/2004 | Olson | A47C 3/04 297/452.14 |
| 2014/0232154 | A1 * | 8/2014 | Chen | A47C 3/026 297/271.1 |
| 2018/0332968 | A1 * | 11/2018 | Djankovich | A47C 7/425 |

* cited by examiner

ROCKING FOLDABLE CHAIR

CROSS REFERENCE TO THE RELATED APPLICATIONS

This application is based upon and claims priority to Chinese Patent Application No. CN 201920893837.1, filed on Jun. 13, 2019, the entire contents of which are incorporated herein by reference.

TECHNICAL FIELD

The present disclosure relates to the field of portable chairs, in particular to a rocking foldable chair.

BACKGROUND

Generally, a person sitting in a folding chair, currently described in prior art, cannot rock the folding chair. The person has to sit upright in the chair currently described in prior art and the person is unable to rock the chair back and forth to relax oneself.

Although certain number of folding chairs can be folded and unfolded, the structure and mechanism is complicated, and the process of folding and unfolding is cumbersome and inconvenient.

Therefore, it is necessary to introduce improvements to the folding chair of the prior art.

SUMMARY

The technical problem to be solved by the present disclosure is as follows. In order to solve one of the problems pointed out in the prior art, the present disclosure provides a rocking foldable chair.

The technical solution employed by the present disclosure to solve the technical problems thereof is as follows.

A rocking foldable chair includes a body frame and a support portion, wherein a connecting portion bent upward is fixed at the first end of the support portion; the connecting portion and the support portion are integrally connected; one end of the connecting portion, away from the support portion, is affixed to the body frame; the second end of the support portion extends toward the rear of the body frame;

when the connecting portion receives an external force, an elastic deformation is generated, causing the body frame to rock.

Preferably, the body frame further includes a first support rod, a second support rod and a second connecting rod;

the lower end of the first support rod forms a first support leg; the lower end of the second support rod forms a second support leg; the first end of the second connecting rod is fixedly connected to the first support rod; the second end of the second connecting rod extends backward and is fixedly connected to the second support rod;

the second support leg is located above the support portion; the second end of the support portion extends backward to the rear of the second support leg; and one end, away from the support portion, of the connecting portion is fixedly connected to the bottom of the first support leg.

Preferably, the body frame further includes a first support rod, a second support rod and a second connecting rod;

the lower end of the first support rod forms a first support leg, the lower end of the second support rod forms a second support leg; the first end of the second connecting rod is fixedly connected to the first support rod; the second end of the second connecting rod extends backward and is fixedly connected to the second support rod;

the second support leg is located above the support portion; the second end of the support portion extends backward to the rear of the second support leg;

one end, away from the support portion, of the connecting portion is fixedly connected to the second connecting rod; and the lower end of the first support rod extends downward to the same height as the bottom surface of the support portion.

Preferably, the second support leg is further provided with a pop-up device capable of providing the second support leg with a resilient force when the second support leg abuts the support portion, and the resilient force makes the second support leg away from the support portion.

Preferably, the pop-up device includes a sleeve, a plunger body, and a compression spring;

the sleeve is provided with a cavity allowing the plunger body to slide up and down and an upward facing opening; the second support leg stretches into the cavity from the opening;

the bottom of the second support leg is provided with an assembling hole, one end of the plunger body is inserted into the assembling hole and forms an interference fit with the assembling hole; a flange protrudes around the plunger body;

the upper end of the compression spring abuts against the flange; the lower end of the compression spring abuts against the bottom of the cavity; and a portion at the opening of the sleeve narrows to form a narrower opening for preventing the flange from passing therethrough.

Preferably, the body frame includes two side brackets that are symmetrical about a first plane; the body frame further includes a linkage mechanism arranged between the two side brackets; the linkage mechanism is fixedly connected to the two side brackets, so that the two side brackets can be away from and approach each other by an external force;

the first plane is parallel to the length direction of the support portion;

the side bracket includes the first support rod, the second support rod, and the second connecting rod;

a first connecting rod extending backward is fixed at the upper end of the first support rod; the length direction of the first connecting rod is parallel to the first plane; a backrest rod protrudes upward from one end, away from the first support rod, of the first connecting rod;

the upper end of the second support rod is fixedly connected to the backrest rod;

the height of the second connecting rod is lower than that of the first connecting rod, and the length direction of the second connecting rod is parallel to the first plane.

Preferably, the linkage mechanism includes two sets of cross mechanisms, the cross mechanism includes two first linkage rods, the two first linkage rods are hinged through a first hinge shaft; the first hinge shaft is located at the middle portion of the first linkage rod, a second linkage rod is also hinged with the first linkage rod, the first end of the second linkage rod is hinged with the first linkage rod through a second hinge shaft, and the second hinge shaft is closer to the upper end of the first linkage rod relative to the first hinge shaft;

in one of the side brackets, the first support rod is hinged with the second end of the second linkage rod on one first linkage rod in one set of the cross mechanisms through a third hinge shaft, and also hinged with the lower end of another first linkage rod through a fourth hinge shaft; the second support rod is hinged with the second end of the second linkage rod on one first linkage rod in another set of the cross mechanisms through a fifth hinge shaft, and also hinged with the lower end of another first linkage rod through a sixth hinge shaft;

the third hinge shaft is closer to the upper end of the first support rod relative to the fourth hinge shaft, and the fifth hinge shaft is closer to the upper end of the second support rod relative to the sixth hinge shaft;

the upper ends of the two first linkage rods hinged to the same side bracket are connected by a first crossbar.

Preferably, the rocking foldable chair further includes a cushion cloth and a backrest cloth, two sides of the cushion cloth are fixedly connected to the two first crossbars respectively, and two sides of the backrest cloth are fixedly connected to the two backrest rods respectively, the bottom of the backrest cloth extends downward and is integratedly connected to the cushion cloth.

The present disclosure has advantages as follows. The rocking foldable chair is convenient for persons to lean on, rock back and forth and relax his/her mind when sitting on the chair. Moreover, the rocking foldable chair is convenient to carry after being folded.

BRIEF DESCRIPTION OF THE DRAWINGS

The present disclosure will be further described hereinafter in conjunction with the drawings and embodiments.

In the drawings.

Figure 1:
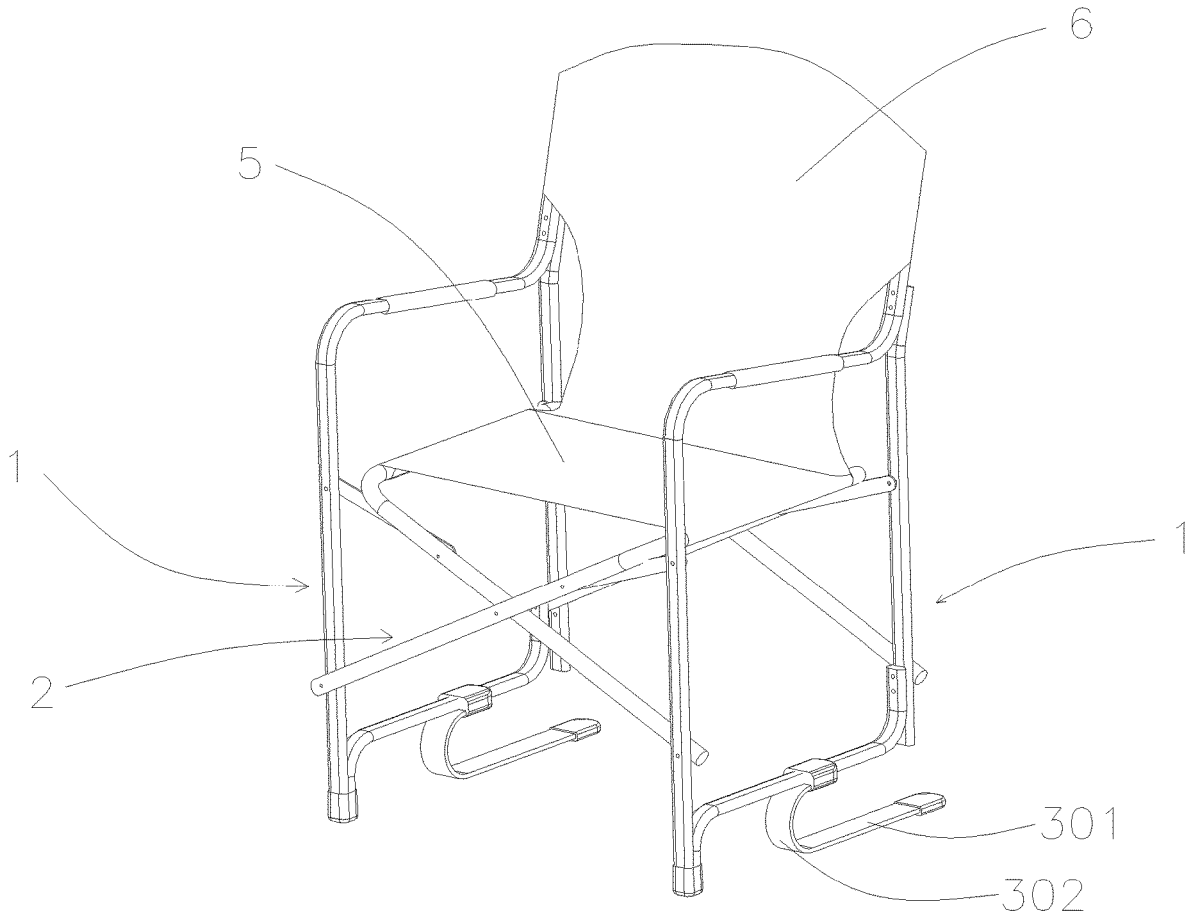
FIG. 1 is a structural schematic diagram of a first embodiment of a rocking foldable chair according to the present disclosure.
Figure 2:
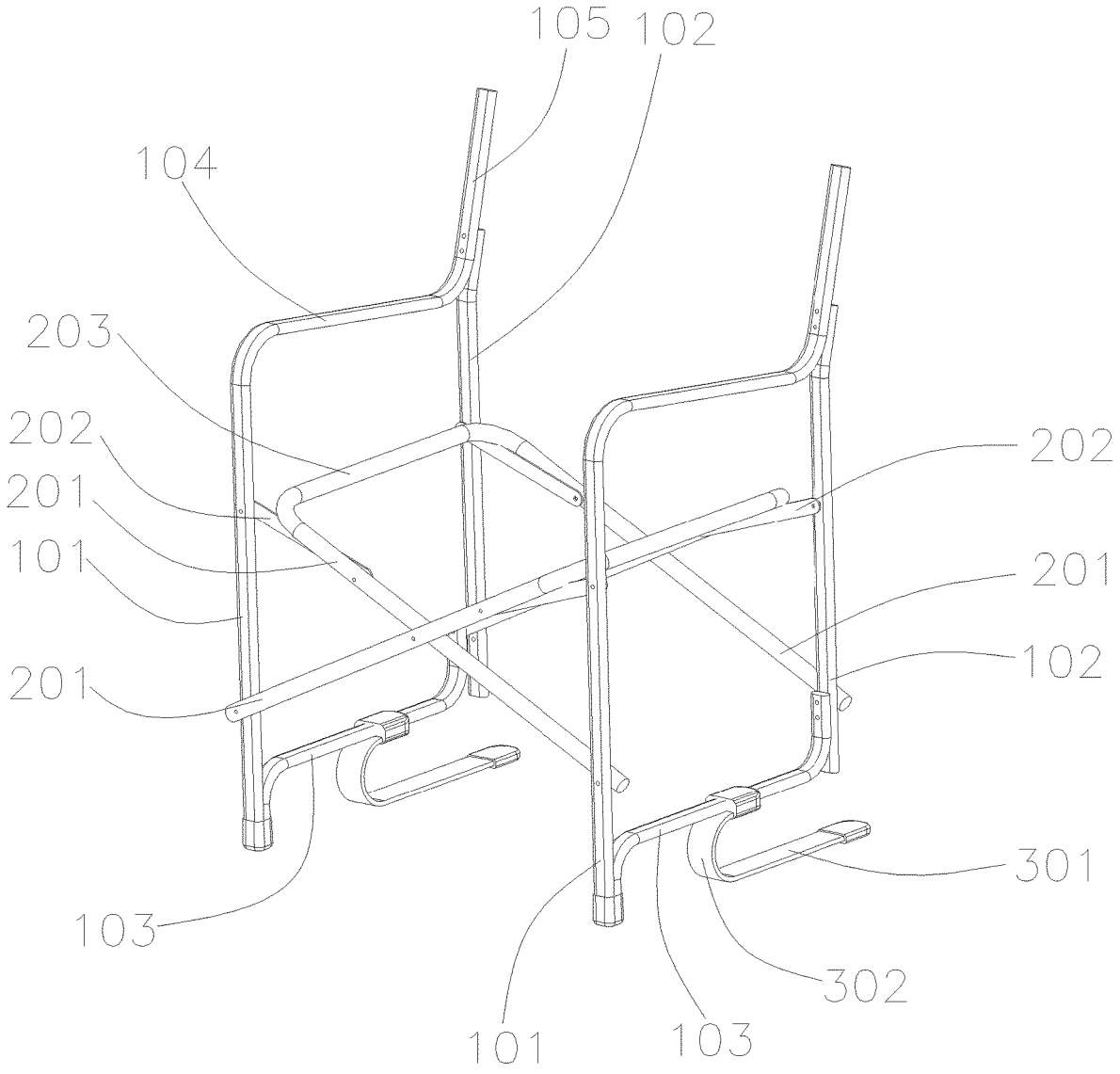
FIG. 2 is a partial structural schematic diagram of the first embodiment of the rocking foldable chair according to the present disclosure.
Figure 3:
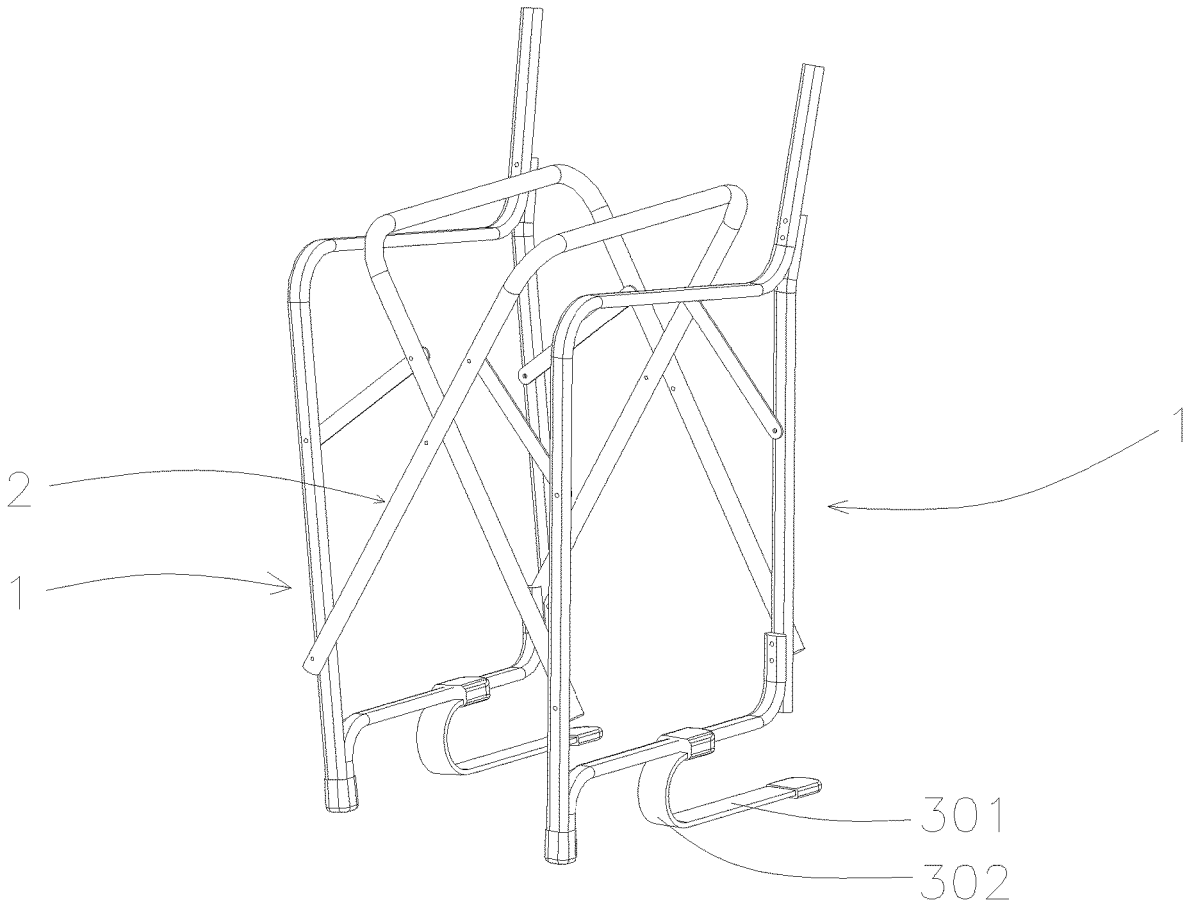
FIG. 3 is a structural schematic diagram of a body frame of the first embodiment of the rocking foldable chair during folding according to the present disclosure.
Figure 4:
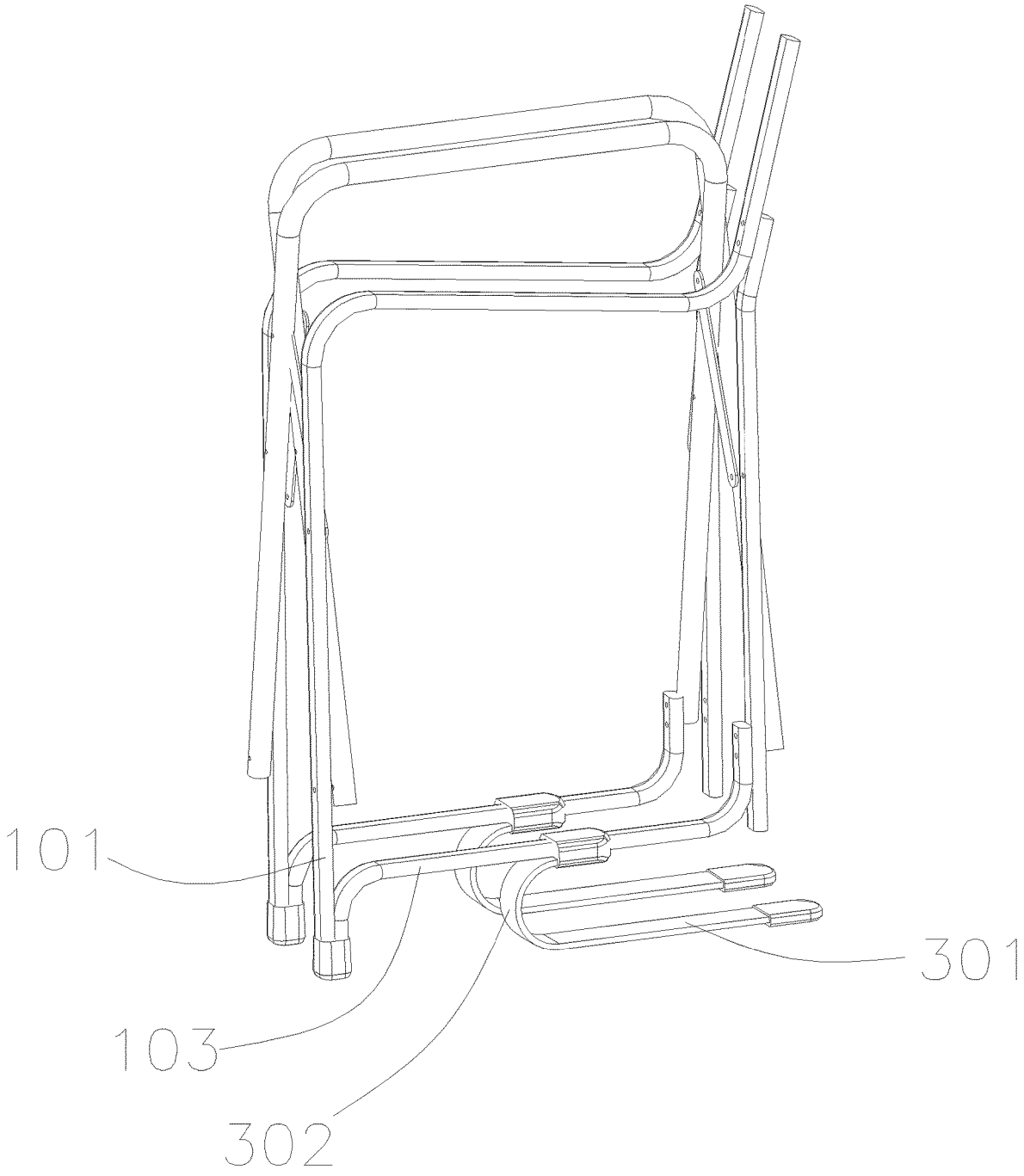
FIG. 4 is a structural schematic diagram of the body frame of the first embodiment of the rocking foldable chair after folding according to the present disclosure.

1, side bracket; 101, first support rod; 102, second support rod; 103, second connecting rod; 104, first connecting rod; 105, backrest rod; 2, linkage mechanism; 201, first linkage rod; 202, second linkage rod; 203, first crossbar; 301, support portion; 302, connecting portion; 4, pop-up device; 401, sleeve; 402, plunger body; 403, flange; 404, compression spring; 405, narrow opening; 5, cushion cloth; 6, backrest cloth.

DETAILED DESCRIPTION OF THE EMBODIMENTS

The embodiments of the present disclosure are described in detail hereinafter, and the examples of the embodiments are illustrated in the drawings, wherein the same or similar reference numerals indicate the same or similar elements or elements having the same or similar functions throughout the drawings. The embodiments described hereinafter with reference to the drawings are exemplary and merely used to elucidate the present disclosure, but cannot be understood as limitations to the present disclosure.

In the description of the present disclosure, it is to be understood that the orientation or positional relationship indicated by the terms "center", "longitudinal", "transverse", "length", "width", "thickness", "upper", "lower", "front", "back", "left", "right", "vertical", "horizontal", "top", "bottom", "inside", "outside", "axial", "radial", "circumferential" and the like shows the orientation or positional relationship based on the drawings, which only facilitates to describe the present disclosure and simplify the description, instead of indicating or implying that the related device or element must have a specific orientation, and be configured and operate in the specific orientation. Therefore, the above contents cannot be understood as limitations to the present disclosure.

Moreover, the terms "first", "second" and the like are merely for descriptive purposes but cannot be understood as indicating or implying the relative importance. In the description of the present disclosure, it should be noted that unless otherwise explicitly specified and limited, the terms "coupled" and "connect" should be understood broadly, and for example, may be a fixed connection, a detachable connection, or an integrated connection; may be a mechanical connection or an electrical connection; may be a direct coupling or an indirect coupling through an intermediate medium. The specific meanings of the above terms in the present disclosure can be understood by those skilled in the art in a specific case. Further, in the description of the present disclosure, the meaning of "a plurality of" is two or more unless otherwise explained.

As shown in FIGS. 1-4, the present disclosure provides a first embodiment of a rocking foldable chair, comprising:

The support portion 301 and the body frame.

The support portion 301 is a metal plate extending toward the rear of the body frame, the connecting portion 302 bent upward is fixed at the first end of the support portion 301, and the connecting portion 302 and the support portion 301 form into a piece.

The body frame includes two side brackets 1 that are symmetrical about a first plane, and the first plane is parallel to the length direction of the support portion 301. The side bracket 1 includes the first support rod 101, the second support rod 102, and the second connecting rod 103.

The first connecting rod 104 extending backward is fixed at the upper end of the first support rod 101, the length direction of the first connecting rod 104 is parallel to the first plane, and the backrest rod 105 protrudes upward from one end away from the first support rod 101 of the first connecting rod 104. The upper end of the second support rod 102 is fixedly connected to the backrest rod 105, and the lower end of the second support rod 102 forms a second support leg.

The length direction of the second connecting rod 103 is parallel to the first plane, and the height of the second connecting rod 103 is lower than that of the first connecting rod 104. The first end of the second connecting rod 103 is fixedly connected to the first support rod 101, and the second end of the second connecting rod 103 extends backward and is fixedly connected to the second support rod 102.

There are two support portions 301 in total, and each support portion 301 corresponds to one second support leg. The second support leg is located above the support portion 301 corresponding thereto. The second end of the support portion 301 extends backward to the rear of the second support leg. One end, away from the support portion 301, of the connecting portion 302 is fixedly connected to the second connecting rod 103, the lower end of the first support rod 101 extends downward to the same height as the bottom surface of the support portion 301, and the lower end of the first support rod 101 forms the first support leg. When the connecting portion 302 is subjected to an external force to generate elastic deformation, the body frame accordingly rocks back and forth.

It should be noted that the material of the connecting portion 302 may be elastic steel material after heat treatment, or plastic material capable of generating elastic deformation by an external force, but the material of the connecting portion 302 is not limited to the above materials. The "rear" indicates the direction of a person's back when the person is sitting on a chair.

The body frame further includes the linkage mechanism 2, and the linkage mechanism 2 is arranged between the two side brackets 1.

The linkage mechanism 2 includes two sets of cross mechanisms, and the cross mechanism includes two first linkage rods 201. The two first linkage rods 201 are hinged through a first hinge shaft and the first hinge shaft is located at a midpoint of the first linkage rod 201. The second linkage rod 202 is also hinged with the first linkage rod 201. The first end of the second linkage rod 202 is hinged with the first linkage rod 201 through a second hinge shaft, and the second hinge shaft is closer to the upper end of the first linkage rod 201 relative to the first hinge shaft.

In one side bracket 1, the first support rod 101 is hinged with the second end of the second linkage rod 202 on one first linkage rod 201 in one set of cross mechanisms through a third hinge shaft, and also hinged with the lower end of another first linkage rod 201 through a fourth hinge shaft. The second support rod 102 is hinged with the second end of the second linkage rod 202 on one first linkage rod 201 in another set of cross mechanisms through a fifth hinge shaft, and also hinged with the lower end of another first linkage rod 201 through a sixth hinge shaft.

The third hinge shaft is closer to the upper end of the first support rod 101 relative to the fourth hinge shaft, and the fifth hinge shaft is closer to the upper end of the second support rod 102 relative to the sixth hinge shaft.

The upper ends of two first linkage rods 201 hinged to the same side bracket 1 are connected by the first crossbar 203.

Specifically, the first hinge axis is located in the first plane. The first hinge shaft, the second hinge shaft, the third hinge shaft, the fourth hinge shaft, the fifth hinge shaft, and the sixth hinge shaft are parallel to each other. In the same side bracket 1, the third hinge shaft and the fifth hinge shaft are collinear, and the fourth hinge shaft and the sixth hinge shaft are collinear.

When the two side brackets 1 approach each other by an external force, the lower ends of the two first linkage rods 201 in the cross mechanism also gradually approach each other, and the cross mechanism is gradually folded. Thus, the entire body frame can be folded. When the two side brackets 1 are pulled away from each other by an external force, and the entire body frame can accordingly be unfolded.

The rocking foldable chair further includes the cushion cloth 5 and the backrest cloth 6. Two sides of the cushion cloth 5 are fixedly connected to the two first crossbars 203 respectively, and two sides of the backrest cloth 6 are fixedly connected to the two backrest rods 105 respectively. The bottom of the backrest cloth 6 extends downward and is connected to and integrated into the cushion cloth 5.

In the present embodiment, the two first support legs and the bottom surfaces of the two support portions 301 contact the ground all together to support the rocking foldable chair. The user sits on the cushion cloth 5, with his/her back leaning on the backrest cloth 6. When the user leans backward, the connecting portion 302 is elastically deformed by an external force so that the user can rock back and forth, and feel comfortable. At the same time, the second end of the support portion 301 extends backward to the rear of the second support leg, that is, the second end of the support portion 301 extends backward beyond the projection position of the second support leg in the vertical direction on the ground, so that when the user leans backward, the center of gravity of the user never exceeds the support range of the support portion 301, thereby ensuring that the rocking foldable chair cannot fall down.

Figure 5:
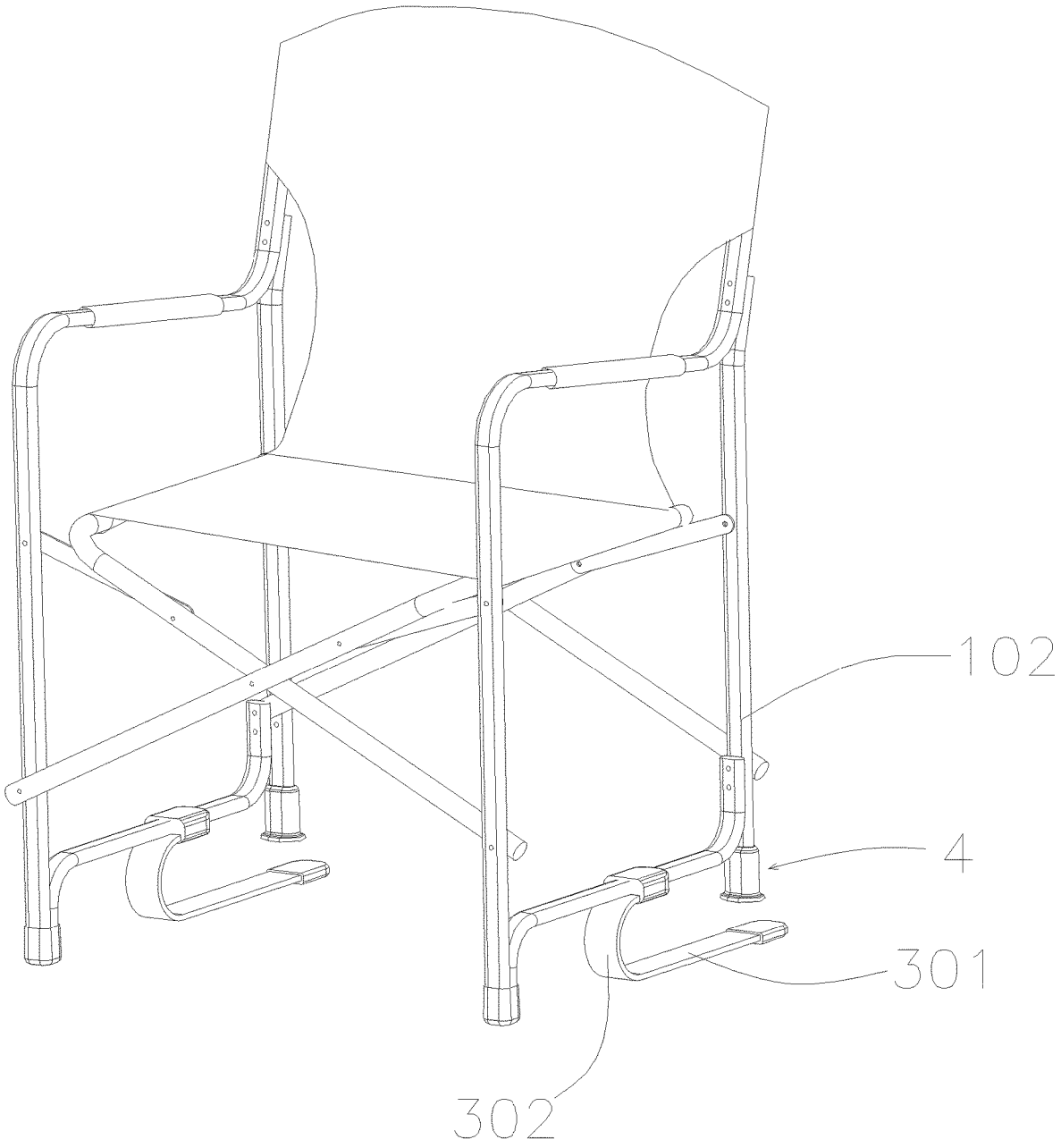
FIG. 5 is a structural schematic diagram of a second embodiment of the rocking foldable chair according to the present disclosure.
Figure 6:
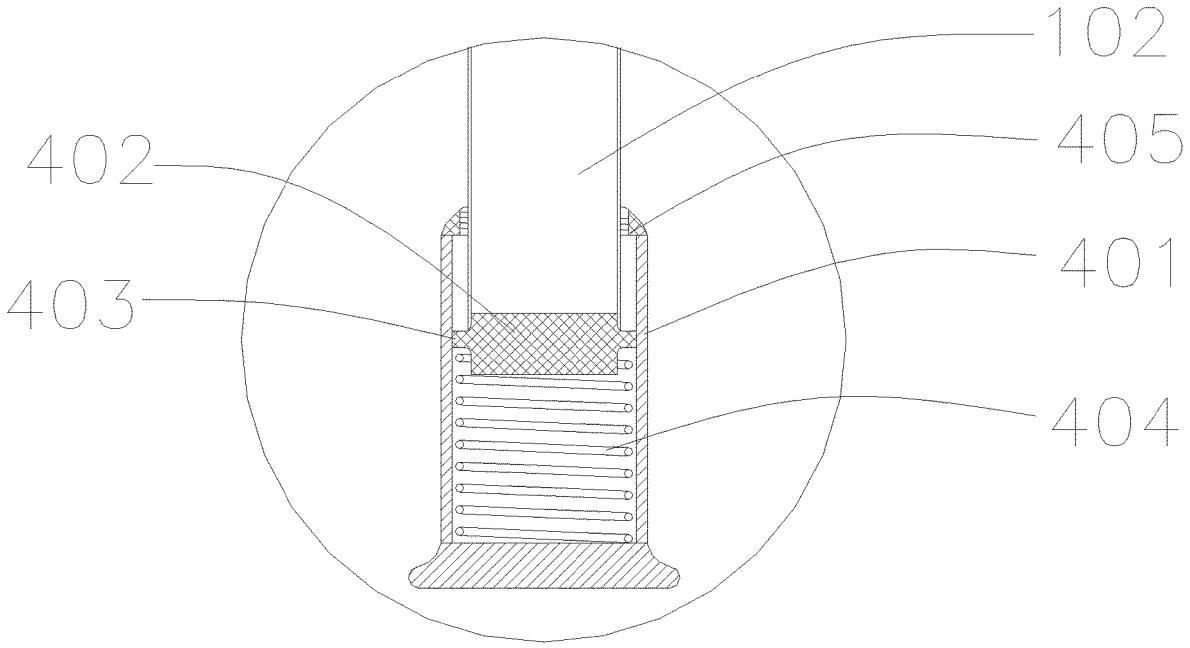
FIG. 6 is a partial cross-sectional view of the second embodiment of the rocking foldable chair according to the present disclosure (wherein the compression spring is in a compressed state).

According to the second embodiment as shown in FIGS. 5 and 6, on the basis of the first embodiment, the second support leg is further provided with the pop-up device 4.

The pop-up device 4 includes the sleeve 401, the plunger body 402, and the compression spring 404.

The sleeve 401 is provided with a cavity allowing the plunger to slide up and down and an opening facing upward. The lower end of the second support rod 102 stretches into the cavity from the opening. The second support rod 102 is a hollow tube, so an assembling hole is formed at the bottom of the second support leg. One end of the plunger body 402 is inserted into the assembling hole and forms an interference fit with the assembling hole. The flange 403 protrude around the plunger body 402. The upper end of the compression spring abuts against the flange 403, and the lower end of the compression spring abuts against the bottom of the cavity. The portion at the opening of the sleeve 401 narrows to form the narrow opening 405 for preventing the flange 403 from passing therethrough.

In the present embodiment, when the user sits on the cushion cloth 5 and leans backward, after the sleeve 401 on the second support leg abuts against the support portion 301, the compression spring 404 in the sleeve 401 is compressed and push the bottom of the cavity in the direction away from the flange 403. In this case, the sleeve 401 is placed on the support portion 301, and the force applied by the compression spring 404 pushes the second support leg away from the support portion 301, which avoids falling down due to the large angle of backward leaning when the user leans backward.

Figure 7:
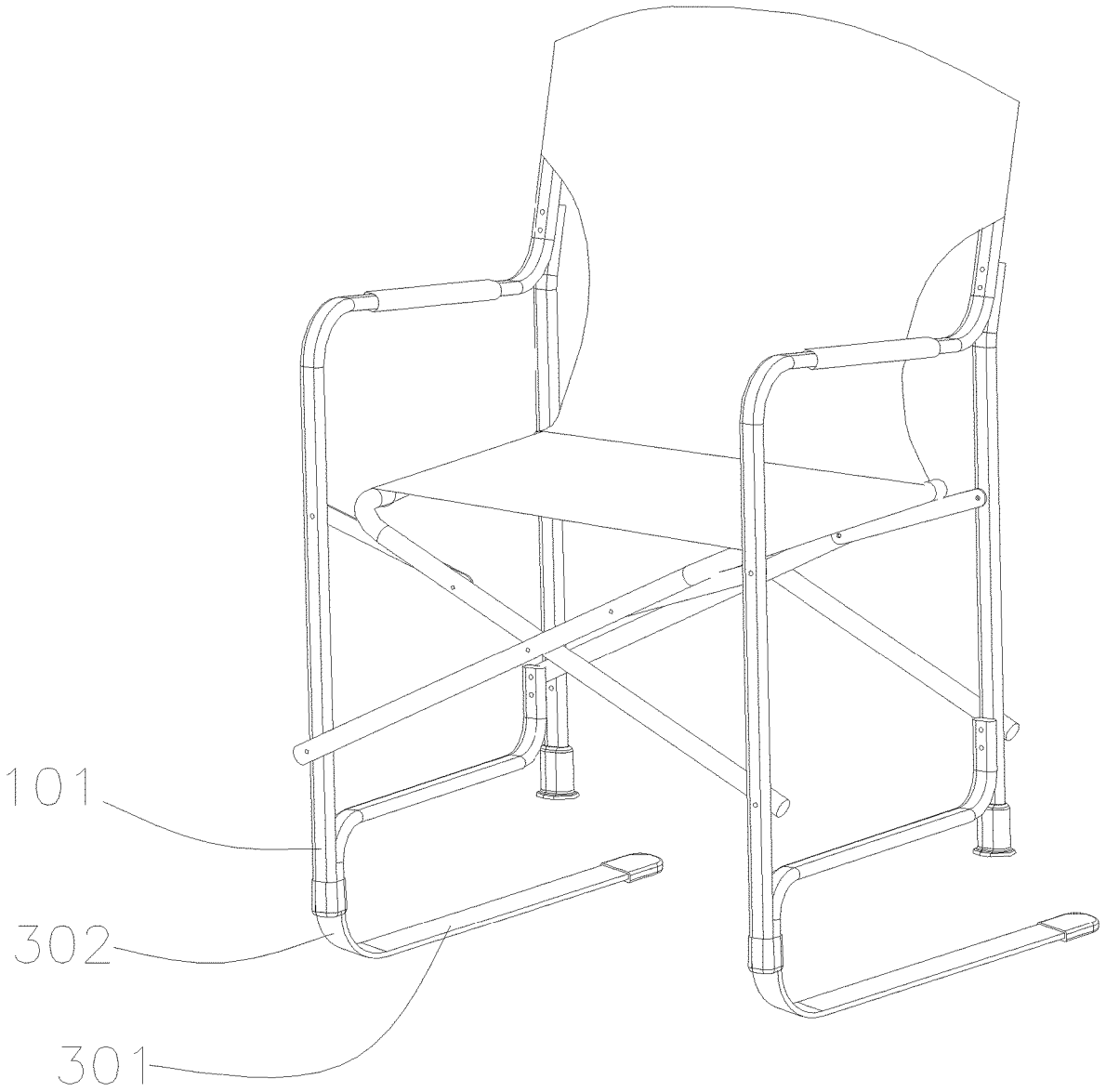
FIG. 7 is a structural schematic diagram of a third embodiment of the rocking foldable chair according to the present disclosure.

According to the third embodiment as shown in FIG. 7, on the basis of the second embodiment, the differences from the second embodiment is that one end, away from the support portion 301, of the connecting portion 302 is not fixedly connected to the second connecting rod 103, but is fixedly connected to the lower end of the first support rod 101.

In the present embodiment, the bottom surfaces of the two support portions 301 contact the ground all together to support the rocking foldable chair.

In the description of the present specification, the terms "one embodiment", "some embodiments", "example", "specific example", or "some examples" and the like means that the specific features, structures, material or characters described in combination with the embodiment or example are contained in at least one embodiment or example of the present disclosure. In the present specification, the indication of the terms does not necessarily refer to the same embodiment or example. Furthermore, the described specific features, structures, material or characters may be combined in a suitable manner in any of one or more embodiments or examples.

Taking the above-described ideal embodiments according to the present disclosure as inspirations, based on the above-described contents, various changes and modifications can be made by the skilled person in the art within the scope of the technical idea of the present disclosure. The technical scope of the present disclosure is not limited to the contents of the specification, and the technical scope thereof must be determined according to the scope of the claims.

What is claimed is:

1. A rocking foldable chair, comprising:

a body frame and a support portion; wherein, a connecting portion bent upward is fixed at a first end of the support portion; the connecting portion and the support portion are formed into a piece; a one end, away from the support portion, of the connecting portion is fixedly connected to the body frame; a second end of the support portion extends toward a rear of the body frame;

the connecting portion is elastically deformed by an external force to rock the body frame back and forth;

the body frame further comprises a first support rod, a second support rod and a second connecting rod;

a lower end of the first support rod forms a first support leg; a lower end of the second support rod forms a second support leg; a first end of the second connecting rod is fixedly connected to the first support rod; a second end of the second connecting rod extends backward and is fixedly connected to the second support rod;

the second support leg is located above the support portion; the second end of the support portion extends backward to a rear of the second support leg; and the one end, away from the support portion, of the connecting portion is fixedly connected to a bottom of the first support leg.

2. The rocking foldable chair according to claim 1, wherein, the one end, away from the support portion, of the connecting portion is fixedly connected to the second connecting rod, and the lower end of the first support rod extends downward to the same height as a bottom surface of the support portion.

3. The rocking foldable chair according to claim 1, wherein, the second support leg is further provided with a pop-up device capable of providing the second support leg with a resilient force when the second support leg abuts the support portion, and the resilient force makes the second support leg away from the support portion.

4. The rocking foldable chair according to claim 3, wherein, the pop-up device comprises a sleeve, a plunger body, and a compression spring;

the sleeve is provided with a cavity allowing the plunger body to slide up and down and an opening facing upward; the second support leg stretches into the cavity from the opening;

a bottom of the second support leg is provided with an assembling hole; one end of the plunger body is inserted into the assembling hole and forms an interference fit with the assembling hole; a flange protrudes around the plunger body;

an upper end of the compression spring abuts against the flange, a lower end of the compression spring abuts against a bottom of the cavity; and a portion at the opening of the sleeve narrows to form a narrow opening for preventing the flange to pass through the narrow opening.

5. The rocking foldable chair according to claim 4, wherein, the body frame comprises two side brackets; the two side brackets are symmetrical about a first plane; the body frame further comprises a linkage mechanism arranged between the two side brackets; the linkage mechanism is fixedly connected to the two side brackets; the two side brackets is away from or approach each other by an external force;

the first plane is parallel to a length direction of the support portion;

each side bracket comprises the first support rod, the second support rod, and the second connecting rod;

a first connecting rod extending backward is fixed at an upper end of the first support rod; a length direction of the first connecting rod is parallel to the first plane; a backrest rod protrudes upward from one end, away from the first support rod, of the first connecting rod;

an upper end of the second support rod is fixedly connected to the backrest rod; and a height of the second connecting rod is lower than a height of the first connecting rod; a length direction of the second connecting rod is parallel to the first plane.

6. The rocking foldable chair according to claim 5, wherein, the linkage mechanism comprises two sets of cross mechanisms; each set of cross mechanism comprises two first linkage rods; the two first linkage rods are hinged through a first hinge shaft; the first hinge shaft is located at a middle portion of the first linkage rod; a second linkage rod is hinged with the first linkage rod; a first end of the second linkage rod is hinged with the first linkage rod through a second hinge shaft; the second hinge shaft is closer to an upper end of the first linkage rod relative to the first hinge shaft;

the first support rod in the each side bracket is hinged with a second end of the second linkage rod on one of the two first linkage rod in a first set of cross mechanism through a third hinge shaft, and also hinged with a lower end of another one of the two first linkage rod in the first set of cross mechanism through a fourth hinge shaft; the second support rod in the each side bracket is hinged with the second end of the second linkage rod on one of the two first linkage rod in a second set of cross mechanism through a fifth hinge shaft, and also hinged with a lower end of another one of the two first linkage rod in the second set of cross mechanism through a sixth hinge shaft;

the third hinge shaft is closer to the upper end of the first support rod relative to the fourth hinge shaft, and the fifth hinge shaft is closer to the upper end of the second support rod relative to the sixth hinge shaft; and the upper ends of the two first linkage rods hinged to the same side bracket are connected by a first crossbar.

7. The rocking foldable chair according to claim 6, further comprising a cushion cloth and a backrest cloth, wherein, two sides of the cushion cloth are fixedly connected to two first crossbars, respectively; two sides of the backrest cloth are fixedly connected to the two backrest rods respectively; and a bottom of the backrest cloth extends downward and is integratedly connected to the cushion cloth.

8. The rocking foldable chair according to claim 2, wherein, the second support leg is further provided with a pop-up device capable of providing the second support leg with a resilient force when the second support leg abuts the support portion, and the resilient force makes the second support leg away from the support portion.

9. The rocking foldable chair according to claim 8, wherein, the pop-up device comprises a sleeve, a plunger body, and a compression spring;

the sleeve is provided with a cavity allowing the plunger body to slide up and down and an opening facing upward; the second support leg stretches into the cavity from the opening;

a bottom of the second support leg is provided with an assembling hole; one end of the plunger body is inserted into the assembling hole and forms an interference fit with the assembling hole; a flange protrudes around the plunger body;

an upper end of the compression spring abuts against the flange, a lower end of the compression spring abuts against a bottom of the cavity; and a portion at the opening of the sleeve narrows to form a narrow opening for preventing the flange to pass through the narrow opening.

10. The rocking foldable chair according to claim 9, wherein, the body frame comprises two side brackets; the two side brackets are symmetrical about a first plane; the body frame further comprises a linkage mechanism arranged between the two side brackets; the linkage mechanism is fixedly connected to the two side brackets; the two side brackets is away from or approach each other by an external force;

the first plane is parallel to a length direction of the support portion;

each side bracket comprises the first support rod, the second support rod, and the second connecting rod;

a first connecting rod extending backward is fixed at an upper end of the first support rod; a length direction of the first connecting rod is parallel to the first plane; a backrest rod protrudes upward from one end, away from the first support rod, of the first connecting rod;

an upper end of the second support rod is fixedly connected to the backrest rod; and a height of the second connecting rod is lower than a height of the first connecting rod; a length direction of the second connecting rod is parallel to the first plane.

11. The rocking foldable chair according to claim 10, wherein, the linkage mechanism comprises two sets of cross mechanisms; each set of cross mechanism comprises two first linkage rods; the two first linkage rods are hinged through a first hinge shaft; the first hinge shaft is located at a middle portion of the first linkage rod; a second linkage rod is hinged with the first linkage rod; a first end of the second linkage rod is hinged with the first linkage rod through a second hinge shaft; the second hinge shaft is closer to an upper end of the first linkage rod relative to the first hinge shaft;

the first support rod in the each side bracket is hinged with a second end of the second linkage rod on one of the two first linkage rod in a first set of cross mechanism through a third hinge shaft, and also hinged with a lower end of another one of the two first linkage rod in the first set of cross mechanism through a fourth hinge shaft; the second support rod in the each side bracket is hinged with the second end of the second linkage rod on one of the two first linkage rod in a second set of cross mechanism through a fifth hinge shaft, and also hinged with a lower end of another one of the two first linkage rod in the second set of cross mechanism through a sixth hinge shaft;

the third hinge shaft is closer to the upper end of the first support rod relative to the fourth hinge shaft, and the fifth hinge shaft is closer to the upper end of the second support rod relative to the sixth hinge shaft; and the upper ends of the two first linkage rods hinged to the same side bracket are connected by a first crossbar.

12. The rocking foldable chair according to claim 11, further comprising a cushion cloth and a backrest cloth, wherein, two sides of the cushion cloth are fixedly connected to two first crossbars, respectively; two sides of the backrest cloth are fixedly connected to the two backrest rods respectively; and a bottom of the backrest cloth extends downward and is integratedly connected to the cushion cloth.

* * * * *